US006390524B1

(12) United States Patent
Plesh, Sr.

(10) Patent No.: US 6,390,524 B1
(45) Date of Patent: May 21, 2002

(54) VEHICLE HAVING EASILY REMOVABLE AND REPLACEABLE AND REUSABLE WHEEL

(76) Inventor: Ronald L. Plesh, Sr., 31 Hemlock Hill, Orchard Park, NY (US) 14127

( * ) Notice: Subject to any disclaimer, the term of this patent is extended or adjusted under 35 U.S.C. 154(b) by 0 days.

(21) Appl. No.: 09/601,839

(22) PCT Filed: Jan. 15, 1999

(86) PCT No.: PCT/US99/00932

§ 371 Date: Jul. 14, 2000

§ 102(e) Date: Jul. 14, 2000

(87) PCT Pub. No.: WO99/36277

PCT Pub. Date: Jul. 22, 1999

Related U.S. Application Data

(60) Provisional application No. 60/071,544, filed on Jan. 15, 1998.

(51) Int. Cl.[7] ..... B60B 37/02

(52) U.S. Cl. ..... 295/39; 295/40; 295/43

(58) Field of Search ..... 295/36.1, 39, 40, 295/43

(56) References Cited

U.S. PATENT DOCUMENTS

| | | | | | |
|---|---|---|---|---|---|
| 1,253,478 | A | * | 1/1918 | Duncan | 295/36.1 |
| 2,101,208 | A | * | 12/1937 | Willoughby | 295/36.1 |
| 3,756,646 | A | * | 9/1973 | Gimlett et al. | 295/43 |
| 3,854,782 | A | * | 12/1974 | MacDonnell | 295/36.1 |
| 4,942,826 | A | * | 7/1990 | Erickson et al. | 295/40 |
| 5,609,108 | A | * | 3/1997 | Chapman | 295/36.1 |
| 5,785,395 | A | * | 7/1998 | Crabb | 295/36.1 |

* cited by examiner

*Primary Examiner*—Joseph D. Pape
*Assistant Examiner*—Greg Blankenship
(74) *Attorney, Agent, or Firm*—James C. Simmons

(57) ABSTRACT

An axle mounting assembly for a vehicle. The assembly comprises a yoke (24) including a generally U-shaped member defining a slot (26) for receiving an axle with the slot extending vertically and having an upper opening. A member (54) is removable attachable to the yoke to close the opening for removably retaining the axle in the yoke. A block (56) is disposed in the slot and spring biased to effect bearing of the block against the axle for distributing the load between the assembly and other axle mounting assemblies.

20 Claims, 5 Drawing Sheets

VEHICLE HAVING EASILY REMOVABLE AND REPLACEABLE AND REUSABLE WHEEL

Priority of U.S. provisional patent application No. 60/071,544, filed Jan. 15, 1998, is hereby claimed.

The present invention relates generally to vehicles such as transfer cars for transporting heavy loads of steel or the like within a plant. More particularly, the present invention relates to mounts for the wheel axles on such vehicles.

Transfer cars have longitudinal and transverse members forming a framework or bed for receiving heavy products for transport within the plant. They have wheels which are received on rails for movement of the transfer car.

The treads (circumferential rail-engaging portions) of transfer car wheels undergo a great amount of wear with the result that they must be replaced often. A conventional transfer car has wheel mounting assemblies wherein the axles are fixedly mounted in holes formed in the longitudinal frame members, and the wheels are rotatably mounted on the axles. Removal and replacement of the wheels accordingly requires the difficult and time-consuming task of disassembling the axles from the holes and re-assembly thereof.

The treads of worn wheels could be re-machined for re-use. However, the re-machining process reduces the tread diameter so that such re-machined wheels have not been usable in conventional transfer cars with the conventional wheel mounts described above.

It is accordingly an object of the present invention to more easily and quickly remove and replace a transfer car axle and wheel.

It is another object of the present invention to re-machine and re-use transfer car wheels.

It is still another object of the present invention to more uniformly distribute load on the wheels.

It is yet another object of the present invention to retrofit existing conventional transfer cars with axle mounts which achieve the above objects.

In order to allow a transfer car wheel to be quickly and easily removed and replaced, in accordance with the present invention, an upwardly opening yoke is formed in the transfer car frame for receiving each end portion of an axle, and the axle is held in position by a retainer cap.

In order to adjust for a reduced diameter of the wheel tread due to re-machining thereof so that the wheel life may be extended, in accordance with the present invention, a shim is installed between each axle end portion and the corresponding retainer cap.

In order to more uniformly distribute load between wheels, in accordance with the present invention, a spring assembly is installed between each axle end portion and the corresponding retainer cap.

The above and other objects, features, and advantages of the present invention will be apparent in the following detailed description of the preferred embodiments of thereof when read in conjunction with the accompanying drawings wherein the same reference numerals denote the same or similar parts throughout the several views.

DETAILED DESCRIPTION OF THE PREFERRED EMBODIMENTS

Figure 1:
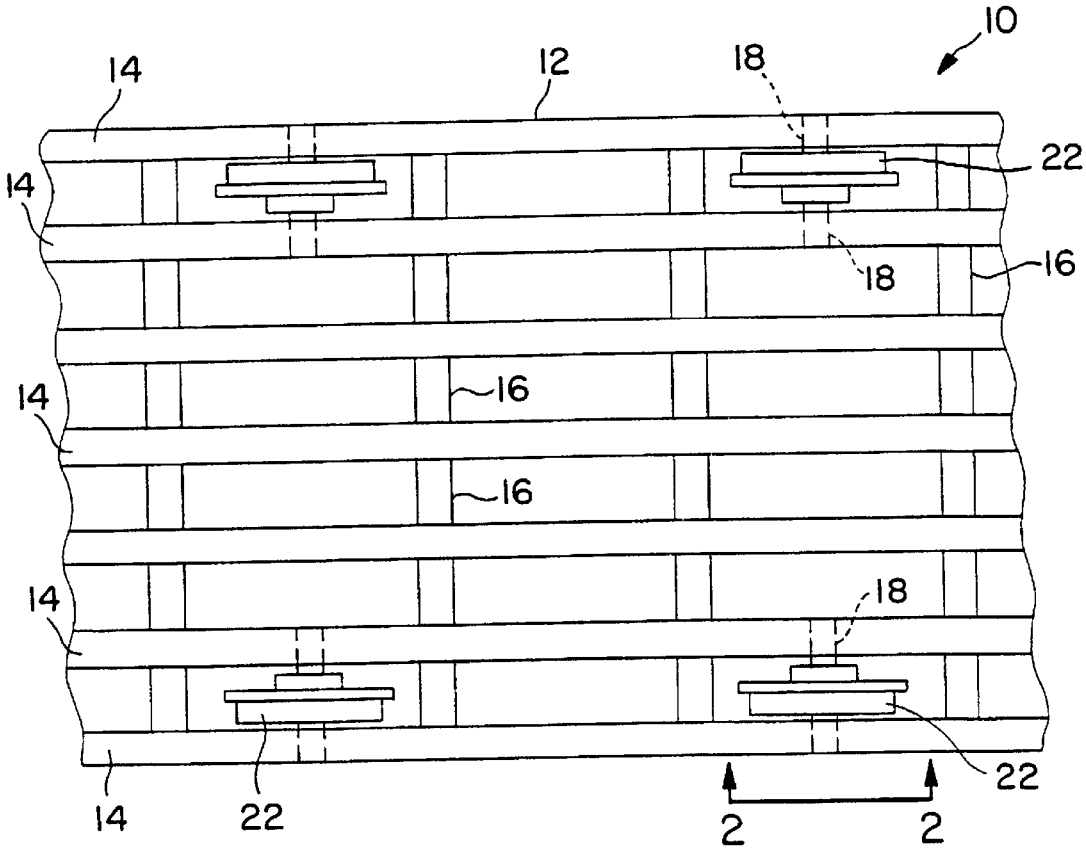
FIG. 1 is a schematic plan view of a transfer car which embodies the present invention.
Figure 2:
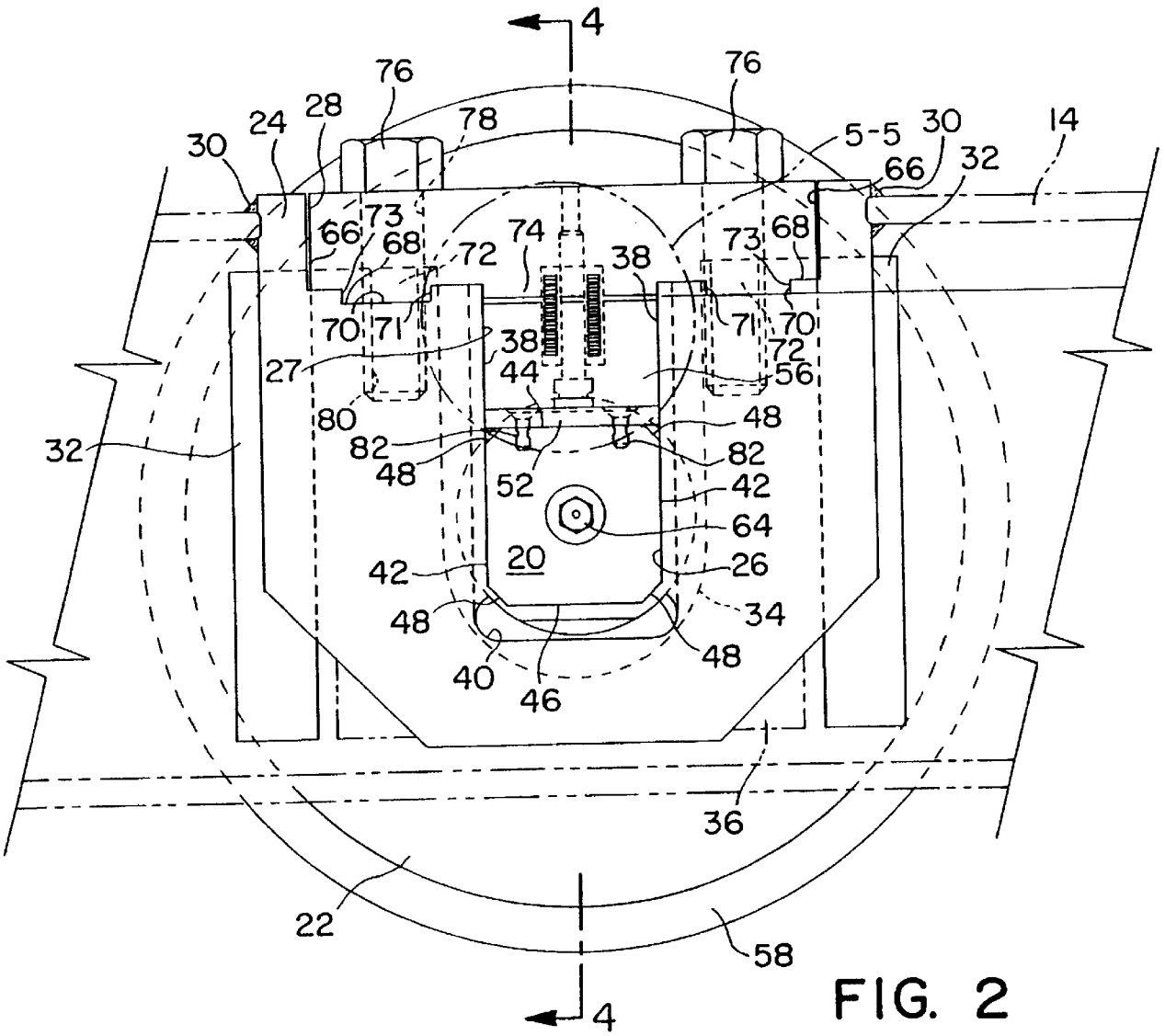
FIG. 2 is an enlarged partial side elevation view thereof taken along lines 2—2 of FIG. 1 and illustrating an axle mount thereof.
Figure 3:
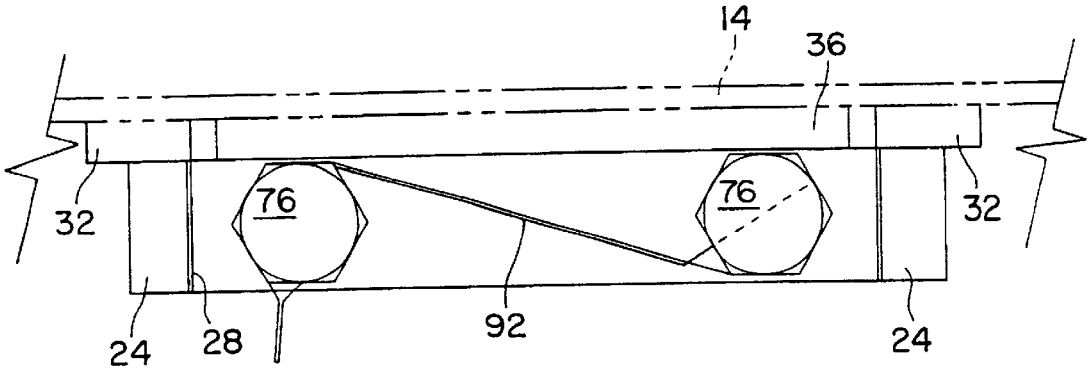
FIG. 3 is a partial plan view of the axle mount.

Referring to FIG. 1, there is illustrated generally at 10 a transfer car which has a bed or platform framework 12 comprising a plurality of steel support members or C-channels 14 extending fore and aft and a plurality of steel transverse support members extending cross-wise thereto and welded thereto. A plurality of axles 20 are mounted on each side of the transfer car 10. The end portions 18 of each axle 20 are mounted to the outer two members 14 on the respective side of the transfer car. 10. A wheel 22 is rotatably mounted on each axle 20 centrally thereof so that the wheel is disposed between the outer two members 14 on its respective side of the car 10. The transfer car 10 may be otherwise suitably constructed.

Referring to FIGS. 2 to 5, there is shown a mounting of the end portions 18 within yokes 24 respectively, which are generally U-shaped members having vertically oblong cut-outs, illustrated at 26, with lower squared passages or slots, illustrated at 27, and with upper enlarged (rectangular) openings, illustrated at 28, through which the axle end portions 18 are received for mounting thereof to the members 14 respectively. The mounting is shown retrofitted in a conventional transfer car, it being understood that a transfer car may alternatively be newly constructed to have a suitable mounting, using principles commonly known to one of ordinary skill in the art to which the present invention pertains.

Since the mountings for both end portions of an axle are similar, only one will be described herein. In order to retrofit the mounting, the existing C-channel as well as an existing side plate 36 are severed as needed to provide a cut-out therein to receive the yoke 24, which is inserted therein and welded thereto, as illustrated by welds 30. A portion of the C-channel, as illustrated at 34, which would otherwise interfere with dropping the axle 20 into the yoke 24, is also suitably removed. Reinforcing vertical backing plates 32 are suitably positioned on the fore and aft sides of the yoke 24, inwardly (toward the wheel 22) of the yoke 24 and adjacent the opening 28, and are suitably welded to the C-channel 14. The yoke 24 is suitably welded to plates 32 and 36. Mounting and reinforcing the yoke 24 may be conducted in other suitable ways and will vary depending on the construction of the transfer car. Since the procedures therefor will vary and are within the knowledge of one of ordinary skill in the art to which the present invention pertains, they will therefore not be described in greater detail herein.

The yoke 24 has uniform width over its height. The side walls 38 of the cut-out 26 are parallel to each other. The bottom of the cut-out 26 is suitably relief undercut, as illustrated at 40. The central portion 50 of the axle 20 is circular in cross-section. The axle portion 18 is truncated by milled flats (removal of material therearound) to have a generally square shape in cross-section. Thus, the axle portion 18 has a pair of sides 42 which, instead of being arcuate, are straight and parallel to each other so as to provide a snug but not tight fit within the slots 27, i.e., so that the axle portion 18 is freely movable vertically within the slot 27 if not otherwise restrained. These milled flats 42 are also provided to prevent axle rotation. The axle portion 18 also has upper and lower sides 44 and 46 respectively which are straight, parallel to each other, and perpendicular to the sides 42. The corners between the sides 42, 44, and 46 remain rounded, as illustrated at 48.

In order to mount the axis 20, the squared or blocked end portions 18, which may have shims or shim blocks 52 attached to their upper sides 44 as hereinafter described, are passed within the respective openings 28 and inserted into squared passages 27 and allowed to fall to the bottoms thereof. Retainer caps 54 with spring assemblies including spring blocks 56, which will be described in greater detail hereinafter, are then applied with the spring blocks 56 received in passages 27 respectively above the respective shim block 52 and the retainer caps 54 received in the rectangular openings 28 respectively and suitably attached to retain the end portions in the desired positions within the yokes 24 respectively.

The wheel 22, which has a single flange tread portion 58 for engaging a rail, is rotatably mounted to the axle 20 by means of a greased bearing assembly, illustrated generally at 60. Bearing assembly 60 comprises roller bearings 63, outer races 65, and endcaps 67 held together by a retainer ring 69 and is provided with grease through passage 62 by grease fitting 64, which is mounted in a counterbore 71 in the center of one end of the axle 20.

The side walls 66 of enlarged rectangular opening 28 are spaced laterally from side walls 38 of the squared passage 27 thereby defining a floor 68 between each wall 38 and the respective wall 66. Each floor 68 has a squared notch 70 extending across the floor 68 intermediate the respective walls 38 and 66. The retainer cap 54 is sized to fit with a small clearance between the walls 66 and flush with the top of the yoke 24. The retainer cap 54 is shaped to conform to the shape of floors 68, thus having squared ridges or protruding portions 72 on its lower surface which are received in notches 70 respectively and further has a similar squared ridge 74 which extends with a small clearance into the passage 27. The retainer cap 54 is further sized so that the ridges 72 fit snugly against the inner walls 71 respectively of notches 70 (with a small clearance with the opposite or outer walls 73) to enhance the strength of the mounting. The retaining cap 54 is tightly secured to the yoke 24 by a pair of screws 76 which pass through apertures 78 in the retaining cap 54 which pass through the ridges 72 and are threadedly received in threaded apertures 80 in the yoke 24. A safety wire 92 is suitably attached to the screws 76, in accordance with principles commonly known to those of ordinary skill in the art to which the present invention pertains, to prevent loosening thereof. Thus, by removing screws 76, the wheel assembly or cartridge may be quickly and easily removed, and it may be quickly and easily replaced after the wheel 22 is re-machined, or, if the wheel is too worn to be re-machined, a new wheel assembly or cartridge may be quickly and easily installed. The re-machined wheel may be retrofitted as a cartridge, i.e., axle, roller bearings, outer race, endcaps, for ease of replacement.

The shim block 52 is provided to compensate for reduction in the wheel outside diameter as a result of re-machining thereof. For example, for a wheel 22 having a diameter of 20 inches, the shim block 52 may have a thickness of about ½ inch. As the wheel diameter is reduced, the shim thickness is increased by half of the diameter increase. Thus, in the above example, if the wheel diameter is reduced to 19 inches, a reduction of diameter of 1 inch, the shim block having a thickness of ½ inch would be replaced with one having a thickness of 1 inch. Thus, the wheel diameter may be reduced in diameter by as much as 1 inch (or perhaps more) before it would need to be replaced, for substantial economic savings. The shim width is desirably slightly less than the width (between walls 38) of the axle end portion 18. The shim block 52 is attached to the respective axle end portion 18 by a pair of screws 82 which extend through apertures 84 in the shim block 52 and are threadedly received in threaded apertures 86 in the axle end portion 18. The heads 88 of screws 82 are received in countersinks 90 in the shim block 52 so that the heads 88 do not obstruct the spring block 56 from lying flat on the shim block 52.

Figure 5:
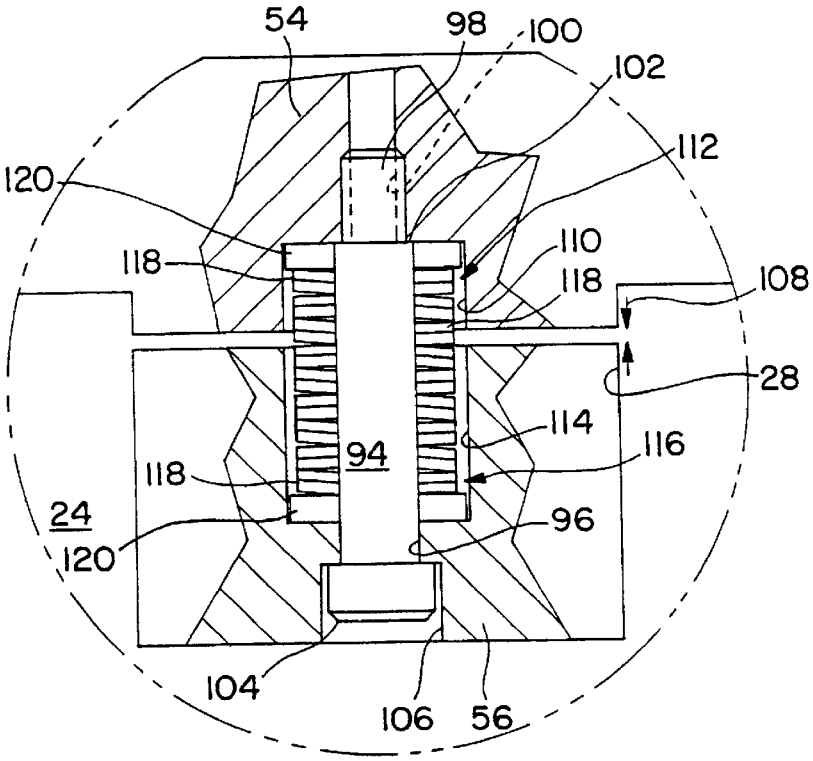
FIG. 5 is an enlarged detail view of the portion thereof encircled by circle indicated at 5—5 in FIG. 2.
Figure 4:
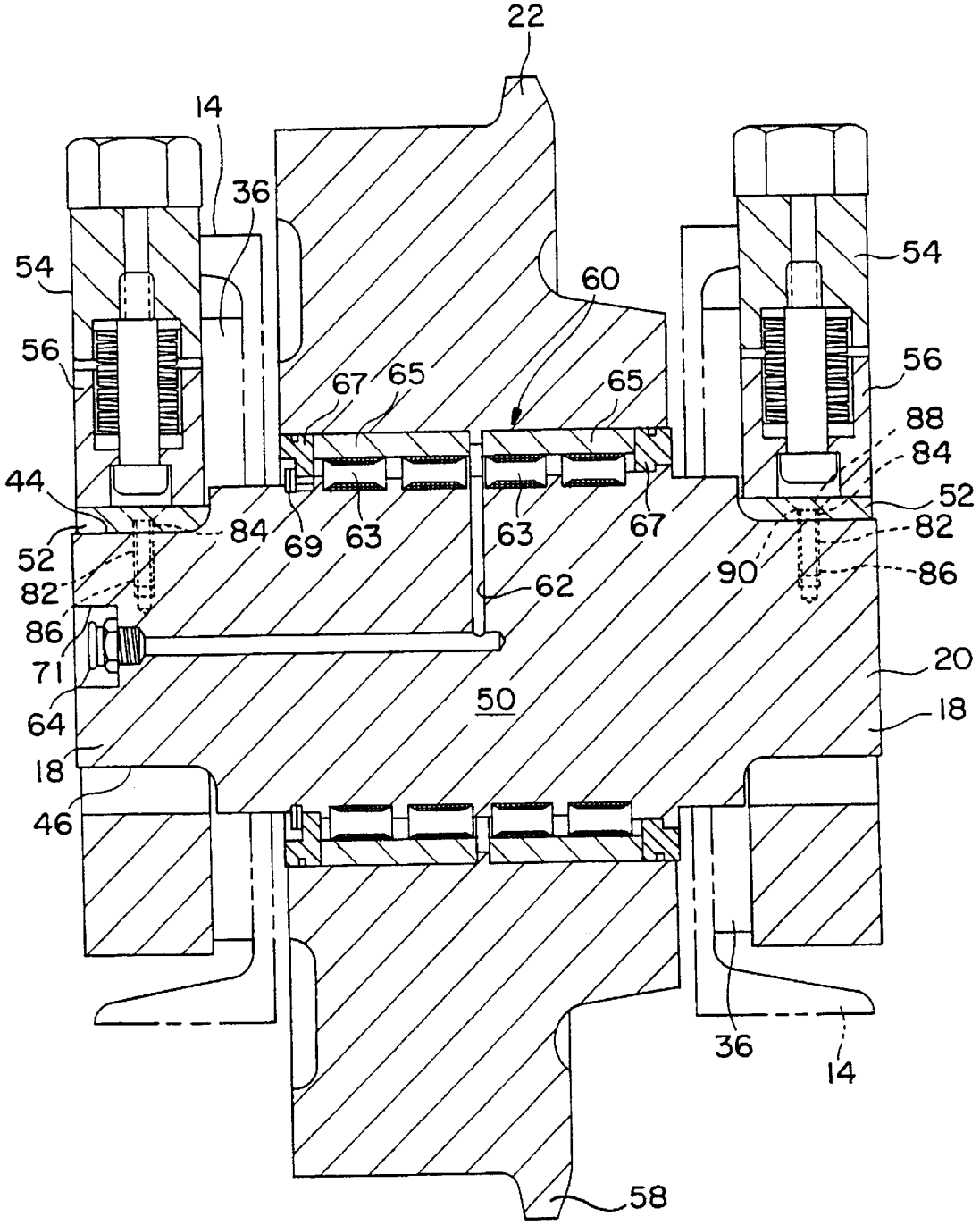
FIG. 4 is a sectional view thereof taken along lines 4—4 of FIG. 2.

Referring to FIG. 5, the spring block 56 is attached to the retainer cap 54 by a screw 94 which passes upwardly through an aperture 96 in spring block 56, and it has a reduced diameter threaded portion 98 which is tightly threadedly received in a threaded aperture 100 in retainer cap 54. The reduced diameter portion 98 defines a shoulder 102 which bottoms on the retainer cap 54. The head 104 of screw 94 is received in a counterbore 106 so that the head 104 does not obstruct the spring block 56 from lying flat on the shim block 52. The distance between the shoulder 102 and the screw head 104 is a fixed distance which is selected to allow a small gap, illustrated at 108, between the spring block 56 and retainer cap 54 and which allows upward movement of the spring block 56 to narrow or close the gap 108, as hereinafter discussed. The lower end of the retainer cap 54 has an increased diameter bore 110 through which the screw passes before threadedly engaging aperture 100, the bore 110 defining an annulus 112 about the screw 94. The upper end of spring block 56 has an increased diameter bore 114 which defines an annulus 116 about the screw 94. A suitable plurality of, for example, 18 Belleville or other suitable spring washers 118 are received to fill both annulus 112 and annulus 116, the number determined in accordance with principles commonly known to one of ordinary skill in the art to which the present invention pertains, to provide a spring assembly to achieve more uniform wheel load distribution. It should be understood that other suitable springs may be provided. A flat washer 120 is received at the bottom of each annulus 112 and 116. The gap 108 may, for example, be about 0.160 inch to allow vertical movement of the wheel over 0.160 inch relative to other wheels so as to relieve the wheel from bearing more than its share of the load.

Figure 6:
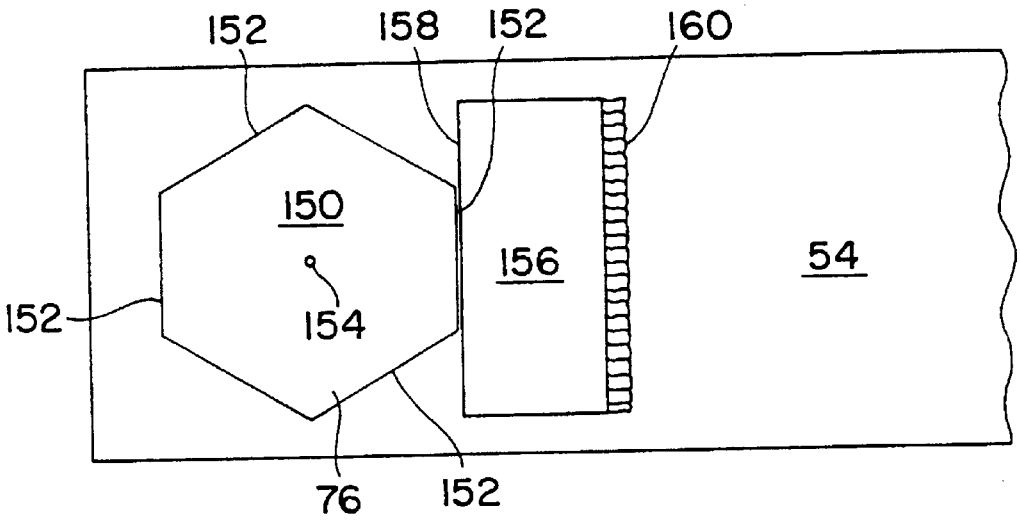
FIG. 6 is a partial plan view of an alternative embodiment of the axle mount.
Figure 7:
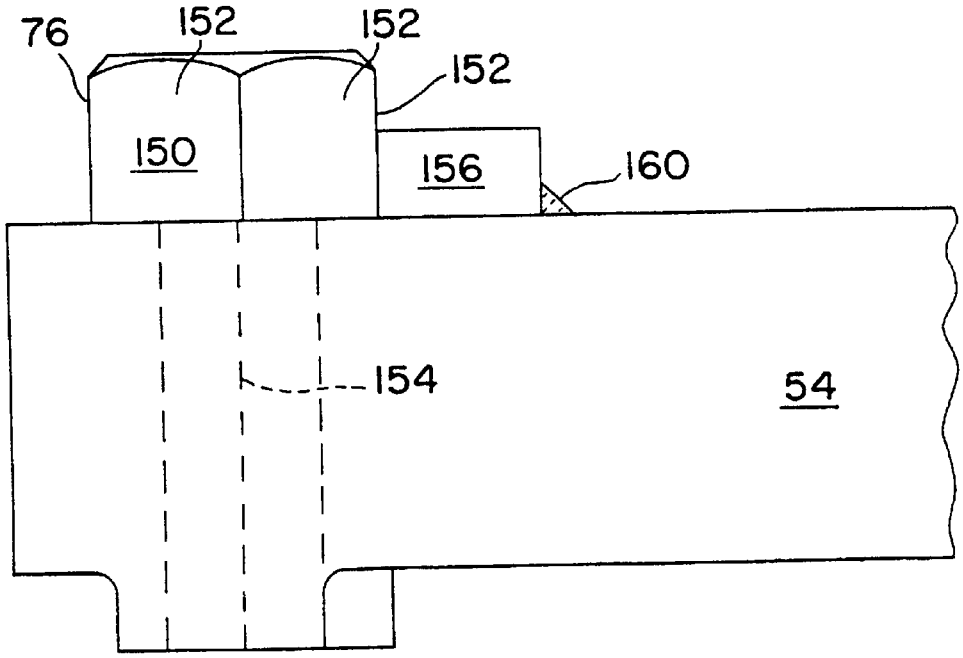
FIG. 7 is a partial side view of the axle mount of FIG. 6.

Referring to FIGS. 6 and 7, each screw or fastener 76 is shown to have a head 150 which is shaped to have a plurality of, for example, 6 planar surfaces 152 (defining a hex-head) circumferentially about the screw longitudinal axis, illustrated at 154, providing means for applying a wrench for loosening and tightening the screw.

In order to provide a more secure means for preventing loosening of the screws 76, in accordance with a preferred embodiment of the present invention, a block 156 of steel or other suitable material having a generally planar surface 158 is welded to closure member 54, as illustrated by weld 160, so that the planar surface 158 closely engages or is adjacent one of the planar surfaces 152 of the screw head 150 to prevent or lock the screw head 150 from being rotated and thereby to prevent loosening of the screw 76. The locking block 156 may be otherwise suitably secured to the closure member or retainer cap 54. In order to remove the screw 76 for repair or replacement of the axle mounting assembly, the weld 160 is suitably cut or removed and the locking block 156 then removed.

The wheel and axle assembly may be retrofitted to form the wheel cartridge of the present invention whereby the cartridge may be easily and quickly removed from the transfer car 10 for repair or re-machining and easily and quickly replaced by the re-machined cartridge or another one. For differences in wheel diameter as a result, the shim thickness may be easily and quickly adjusted by increasing or decreasing the thickness thereof. The spring assembly allows a more uniform load distribution.

Although the invention has been described in detail herein, it should be understood that the invention can be embodied otherwise without departing from the principles thereof, and such other embodiments are meant to come within the scope of the present invention as defined in the appended claims.

What is claimed is:

1. An axle mounting assembly for a vehicle comprising a yoke including a generally U-shaped member defining a slot for receiving an axle with the slot extending vertically and having an upper opening, a member removably attachable to said yoke to close the opening for removably retaining the axle in said yoke, and means for distributing load between the assembly and other axle mounting assemblies for the vehicle, said load distributing means comprising a block disposed in the slot and spring means for connecting said block to said closure member and biased to effect bearing of said block against the axle.

2. An assembly according to claim 1 further comprising shim means disposable between said block and the axle.

3. An assembly according to claim 2 wherein said shim means is attachable to the axle.

4. An assembly according to claim 1 wherein said yoke has a pair of generally parallel walls which define the slot.

5. An assembly according to claim 1 further comprising at least one fastener for attaching said closure member to said yoke, said fastener having a longitudinal axis and a head which is shaped to have a plurality of planar surfaces about said longitudinal axis for receiving a wrench, and means for preventing loosening of said fastener.

6. An assembly according to claim 5 wherein said loosening preventing means comprises a member removably attachable to said closure member to bear against one of said planar surfaces.

7. An assembly according to claim 6 wherein said bearing member is welded to said closure member.

8. An assembly according to claim 1 wherein said spring means comprises means defining a pair of aligned bores in said block and in said closure member respectively and having bottom surfaces, means defining an aperture in one of said bottom surfaces, means defining a threaded aperture in an other of said bottom surfaces, a screw slidingly received in said an aperture means and threadedly received in said threaded aperture whereby said block is movable relative to said closure member, and a spring received in said bores and surrounding said screw and biased to urge said block and said closure member apart.

9. An assembly according to claim 8 wherein said threaded aperture is in said closure member bore bottom surface, said screw having a head, and the assembly further comprises means defining a countersunk bore in said block for receiving said screw head.

10. An assembly according to claim 1 wherein said yoke has a pair of upstanding portions defining the slot and having upper surfaces respectively and a pair of outer wall portions extending above said upper surfaces, each of said upper surfaces has means defining a notch therein, said closure member disposed to lie on said upper surfaces between said wall portions and has a lower central protruding portion which is sized to fit between said upstanding portions and a pair of lower protruding portions which are sized and positioned to fit within said notch means respectively.

11. A vehicle comprising a frame, a plurality of axles, means for mounting end portions of said axles to said frame, at least one wheel rotatably mounted on each of said axles and having tread means for engaging a rail, at least one of said axle mounting means comprising a yoke including a generally U-shaped member defining a slot or receiving said respective axle with the slot extending vertically and having an upper opening, and a member removably attachable to said yoke to close the opening for removably retaining the axle in said yoke, the vehicle further comprising means for distributing load between said at least one axle mounting means and other axle mounting means, said load distributing means comprising a block disposed in the slot and spring emans for connecting said block to said closure member and biased to effect bearing of said block against said axle.

12. A vehicle according to claim 11 further comprising shim means disposed betwen said block and said respective axle.

13. A vehicle according to claim 12 wherein said shim means is attached to said respective axle.

14. A vehicle according to claim 11 wherein said yoke has a pair of generally parallel walls which define the slot, said respective axle having a pair of complementary parallel walls which are received adjacent said yoke parallel walls respectively whereby to prevent rotation of said respective axis.

15. A vehicle according to claim 11 further comprising at least one fastener for attaching said closure member to said yoke, said fastener having a longitudinal axis and a head which is shaped to have a plurality of planar surfaces about said longitudinal axis for receiving a wrench, and means for preventing loosening of said fastener.

16. A vehicle according to claim 15 wherein said loosening preventing means comprises a member removably attached to said closure member to bear against one of said planar surfaces.

17. A vehicle according to claim 16 wherein said bearing member is welded to said closure member.

18. A vehicle according to claim 11 wherein said spring means comprises means defining a pair of aligned bores in said block and in said closure member respectively and having bottom surfaces, means defining an aperture in one of said bottom surfaces, means defining a threaded aperture in an other of said bottom surfaces, a screw slidingly received in said an aperture means and threadedly received in said threaded aperture whereby said block is movable relative to said closure member, and a spring received in said bores and surrounding said screw and biased to urge said block and said closure member apart.

19. A vehicle according to claim 11 wherein the vehicle is a transfer car for transporting heavy loads within a plant.

20. A vehicle according to claim 11 wherein said at least one axle mounting means is retrofitted in the vehicle by forming a cut-out in the frame, inserting said at least one axle mounting means in the cut-out and welding said at least one axle mounting means to said frame, and welding reinforcing plates to said at least one axle mounting means and said frame.

* * * * *

UNITED STATES PATENT AND TRADEMARK OFFICE

CERTIFICATE OF CORRECTION

PATENT NO. : 6,390,524 B1
DATED : May 21, 2002
INVENTOR(S) : Ronald L. Plesh, Sr.

It is certified that error appears in the above-identified patent and that said Letters Patent is hereby corrected as shown below:

Column 6,
Line 10, "or" should read -- for --.

Signed and Sealed this

Seventeenth Day of June, 2003

JAMES E. ROGAN
*Director of the United States Patent and Trademark Office*